US006660152B2

(12) United States Patent
Nayfeh et al.

(10) Patent No.: US 6,660,152 B2
(45) Date of Patent: Dec. 9, 2003

(54) ELEMENTAL SILICON NANOPARTICLE PLATING AND METHOD FOR THE SAME

(75) Inventors: Munir H. Nayfeh, Urbana, IL (US); Gennadiy Belomoin, Wheeling, IL (US); Adam Smith, New Haven, IN (US); Taysir Nayfeh, Cleveland, OH (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 10/002,865

(22) Filed: Nov. 15, 2001

(65) Prior Publication Data

US 2003/0089611 A1 May 15, 2003

(51) Int. Cl.[7] ..... C25D 15/00

(52) U.S. Cl. ..... 205/109; 205/157; 205/123; 205/170; 205/316; 205/320; 204/490; 204/492; 204/499

(58) Field of Search ..... 205/109, 157, 205/118, 170, 123, 134, 316, 320; 204/490, 492, 499

(56) References Cited

U.S. PATENT DOCUMENTS 6,361,660 B1 * 3/2002 Goldstein ..... 204/157.15
2002/0104762 A1 * 8/2002 Stonas et al. ..... 205/118

OTHER PUBLICATIONS

Akcair, J. Therrien, G. Belomoin, N. Barry, J.D. Mueller, E. Gratton, and M. Nayfeh, "Detection of luminescent single ultrasmall silicon nanoparticles using fluctuation correlation spectroscopy", Applied Physics Letters, vol. 76, No. 14, Apr. 3, 2000, pp. 1857–1859.

M. Nayfeh, O. Akcakir, J. Therrien, Z. Yamani, N. Barry, W. Yu, and E. Gratton, "Highly nonlinear photoluminescence threshold in porous silicon", Applied Physics Letters, vol. 75, No. 26, Dec. 27, 1999, pp. 4112–4113.

M.H. Nayfeh, N. Barry, J. Therrien, O. Akcakir, E. Gratton, and G. Belomoin, "Stimulated blue emission in reconstituted films of ultrasmall silicon nanoparticles", Applied Physics Letters, vol. 78, No. 8, Feb. 19, 2001, pp. 1131–1133.

M.H. Nayfeh, O. Akcakir, G. Belomoin, N. Barry, J. Therrien, and E. Gratton, "Second harmonic generation in microcrystallite films of ultrasmall Si nanoparticles", Applied Physics Letters, vol. 77, No. 25, Dec. 18, 2000, pp. 4086–4088.

Joel Therrien, Gennadiy Belomoin, and Munir Nayfeh, "Light–induced conductance resonance in ultrasmall Si nanoparticles", Applied Physics Letters, vol. 77, No. 11, Sep. 11, 2000, pp. 1668–1770.

Gennadiy Belomoin, Joel Therrien, and Munir Nayfeh, "Oxide and hydrogen capped ultrasmall blue luminescent Si nanoparticles", Applied Physics Letters, vol. 77, No. 6, Aug. 7, 2000, pp. 779–781.

W. Howard Thompson, Zain Yamani, Laila AbuHassan, Osman Gurdal, and Munir Nayfeh, The effect of ultrathin oxides on luminescent silison nanocrystallites, Applied Physics Letters, vol. 73, No. 6, Aug. 10, 1998.

W. Howard Thompson, Zain Yamani, Laila H. Abu Hassan, J.E. Greene, and Munir Nayfeh, "Room temperature oxidation enhancement of porous Si(001) using ultraviolet–ozone exposure", J. Appl. Phys. 80 (9), Nov. 1, 1996, pp. 5415–5421.

E. Rogozhina, G. Belomoin, A. Smith, L. Abuhassan, N. Barry and O. Akcakir, P.V. Braun, M.H. Nayfeh, "Si–N linkage in ultrabright, ultrasmall Si nanoparticles", Applied Physics Letters, vol. 78. No. 23, Jun. 4, 2001, pp. 3711–3713.

L. Mitas, J. Therrien, R. Twesten, G. Belomoin, and M.H. Nayfeh, "Effect of surface reconstruction on the structural prototypes of ultrasmall ultrabright $Si_{29}$ nanoparticles", Applied Physics Letters, vol. 78, No. 13, Mar. 26, 2001, pp. 1918–1920.

Zain Yamani, W. Howard Thompson, Laila AbuHassan, and Munir H. Nayfeh, "Ideal anodization of silicion", Applied Phys. Lett. 70 (25), Jun. 23, 1997, pp. 3404–3406.

D. Andsager, J. Hilliard, J.M. Hetrick, L.H. AbuHassan, M. Pilsch, and M.H. Nayfeh, "Quenching of porous silicon photoluminescence by depostion of metal adsorbates", J. Appl. Phys. 74 (1), Oct. 1, 1993, pp. 4783–4785.

Zain Yamani, Sahel Ashhab, ammar Nayfeh, W. Howard Thompson, and Munir Nayfeh, "Red to green rainbow photoluminescence from unoxidized silicon nanocrystallites", Journal of Applied Physics, vol. 83, No. 7, Apr. 1, 1998, pp. 3929–3931.

(List continued on next page.)

*Primary Examiner*—Roy King
*Assistant Examiner*—Wesley A. Nicolas
(74) *Attorney, Agent, or Firm*—Greer, Burns & Crain, Ltd.

(57) ABSTRACT

According to the invention, silicon nanoparticles are applied to a substrate using an electrochemical plating processes, analogous to metal plating. An electrolysis tank of an aqueous or non-aqueous solution, such as alcohol, ether, or other solvents in which the particles are dissolved operates at a current flow between the electrodes. In applying silicon nanoparticles to a silicon, metal, or non-conducting substrate, a selective area plating may be accomplished by defining areas of different conductivity on the substrate. Silicon nanoparticle composite platings and stacked alternating material platings are also possible. The addition of metal ions into the silicon nanoparticle solution produces a composite material plating. Either composite silicon nanoparticle platings or pure silicon nanoparticle platings may be stacked with each other or with convention metal platings.

17 Claims, No Drawings

OTHER PUBLICATIONS

Eric J. Lee, Theodore W. Bitner, James S. Ha, Michael J. Shane, and Michael J. Sailor, "Light–Induced Reactions of Porous and Single–Crystal Si Surfaces with Carboxylic Acids", *J. Am. Chem Soc.* 1996, 118, pp. 5375–5382, No Month Avail.

Eric J. Lee, James S. Ha, and Michael J. Sailor, "Photo-derivatization of the Surface of Luminescente Porous Silicon with Formic Acid", *J. Am. Chem. Soc.* 1995, 117, pp. 8295–8296, No Month Avail.

Vincent V. Doan and Michael J. Sailor, "Photolithographic fabrication of micro–dimension of porous Si structures exhibiting visible luminescence", Appl. Phys.Lett. 60 (5), Feb. 3, 1992, pp. 619–620.

D.A. Williams, R.A. McMahon, and H. Ahmed, "Seed Window Defects in Silicon on Insulator Material", Applied Surface Science 36 (1989), pp. 614–622, no month avail.

M. Warntjes, C. Vieillard, F. Ozanam, and J.–N. Chazalviel, "Electrochemical Methoxylation of Porous Silicon Surface", *J. Electrochem. Soc.*, vol. 142, No. Dec. 1995, pp. 4139–4142.

* cited by examiner

ELEMENTAL SILICON NANOPARTICLE PLATING AND METHOD FOR THE SAME

STATEMENT OF GOVERNMENT INTEREST

This invention was made with United States government assistance through the National Science Foundation under Contract Number BES 0118053. The government has certain rights in this invention.

FIELD OF THE INVENTION

A field of the invention is electrochemical plating processes. Another field of the invention is semiconductors.

BACKGROUND OF THE INVENTION

Silicon nanoparticles are an area of intense study. When certain size thresholds are reached, elemental silicon nanoparticles demonstrate properties unlike the properties of bulk or atomic silicon. For example, silicon nanoparticles of ~1 nm diameter have shown stimulated emissions. Unlike bulk Si, an optically inert indirect gap material, ~1 nm diameter particles are extremely active optically, exceeding the activity of fluorescein or coumarine, such that single particles are readily detected and imaged, using two-photon near-infrared femto second excitation. See, e.g., Akcakir et al, Appl. Phys. Lett. 76, p. 1857 (2000); Nayfeh et al., Appl. Phys. Left. 75, p. 4112 (1999). Silicon nanoparticles have been synthesized with H— or O— or functionalized with N—, or C— linkages.

SUMMARY OF THE INVENTION

The present invention is directed to silicon nanoparticle plating. The plating of a uniform layer of silicon nanoparticles on various substrates, including metals and silicon, is provided by the invention. The plating method of the invention allows the physical incorporation of silicon nanoparticles onto important substrates.

According to the invention, silicon nanoparticles are applied to a substrate using an electrochemical plating processes, analogous to metal plating. An electrolysis tank of an aqueous or non-aqueous solution, such as alcohol, ether, or other solvents in which a colloid of particles are dissolved operates at a current flow between the electrodes when power is applied thereto. In applying silicon nanoparticles to silicon substrates, a selective area plating may be accomplished by defining areas of different conductivity on the silicon substrate.

Silicon nanoparticle composite platings and stacked alternating material platings are also possible. The addition of metal ions into the silicon nanoparticle solution produces a composite material plating. Either composite silicon nanoparticle platings or pure silicon nanoparticle platings may be stacked with each other or with conventional metal platings.

DETAILED DESCRIPTION OF THE PREFERRED EMBODIMENTS

The invention is a plating method for plating silicon nanoparticles from an solution to a substrate of metal or silicon. Silicon nanoparticles are plated in an electrolytic cell to the substrate, which is the anode of the cell when plating silicon nanoparticles and may be the cathode for composite deposits including silicon nanoparticles. The electrolytic cell for plating with the silicon nanoparticles is otherwise the same configuration as conventional tanks used in metal plating. For biasing in the range of 100 to 500 Volts, the tank usually supports a current flow of ~100 to 300 micro ampere respectively, with electrodes separated by ~1 cm. An increase in the water trace in the solution increases the current flow. A decrease in the electrode spacing increases the current flow.

A silicon nanoparticle source in the electrolytic cell is a colloid of the particles. In experiments conducted, the electrolytic tank in which 1 nm blue luminescent particles are dissolved was observed under ultraviolet illumination at 365 nm from an incoherent ultraviolet lamp. The solution exhibits strong blue luminescence visible to the naked eye and attributable to the dispersed silicon nanoparticles.

A stainless steel plate was plated by the above-described steps. The plated stainless steel plate was examined under ultraviolet illumination at 365 nm. The stainless steel plate exhibited the characteristic luminescence that was observed in the solution. This indicated a successful plating of the luminescence particles on the stainless steel plate. Successful plating of silicon substrates was also experimentally demonstrated on other substrates. The substrates can be p-type or n-type. Using the method of the invention, a p-type silicon wafer has been plated by simply replacing the conducting substrate with a silicon substrate.

In the electroplating of silicon nanoparticles from the solution to the silicon wafer, we find additional particles deposit as a narrow line along the solution-air interface (the meniscus). This is due to the fact that the conductivity of the substrate is lower than the conductivity of the liquid, resulting in a higher concentration of the current at the meniscus, such that it penetrates the least distance into the semiconductor. This may be addressed by gradually advancing the substrate to be plated into the solution thereby sweeping the meniscus uniformly over a large area of the anode electrode.

A selective area plating may be achieved by defining different areas of conductivity on the substrate to be plated. An oxide pattern establishes a basis for conductivity patterns on a silicon wafer. The thickness of the oxide may range from a few nanometers to hundreds of nanometers. In an experimental plating according to the invention, a thermal oxide layer of 300 nm was grown on a p-type 100 Si substrate. Patterns in the oxide were etched away to provide current paths. The substrate was then plated. Silicon nanoparticles selectively deposited in the pattern area. A variety of patterns on silicon wafers were deposited in this manner.

We examined platings deposited according to the method of the invention by Fourier transform infrared (FTIR) spectroscopy. Control samples were first prepared by precipitating particles on a silicon substrate by simple evaporation. The FTIR of this type of sample presented is dominated by hydrogen and only 10 percent Si—O stretching at 1050 $cm^{-1}$. Vibrations at 520–750 $cm^{-1}$ are observed due to Si—$H_2$ scissors or Si—$H_3$ symmetric or anti-symmetric deformation, and another at 880–900 $cm^{-1}$ is due to Si—H wagging. Observed vibrations at 2070–2090 cm−1 are characteristic of stretching monohydrides and coupled (reconstructed) H—Si—Si—H (H attached to Si atoms with Si—Si bonding arrangements different than for bulk Si). In contrast, the FTIR of plated silicon wafer samples shows that hydrogen has been removed and replaced by a strong Si—O stretch at ~1050 $cm^{-1}$. There are no peaks at 2869, 2881, 2931, and 2966 $cm^{-1}$ characteristics of C—H stretch vibrations in $CH_3$ or $CH_2$ groups. An observed vibration at ~2300 pertains to $CO_2$, air and oxygen. The absence of OH vibrations at 3400 $cm^{-1}$ indicates the absence of physioabsorbed (free) alcohol on the silicon nanoparticle plated film. X ray Photo Spectroscopy (XPS) studies confirm the FTIR.

The method of the invention was also verified on several other metallic objects. An alligator clip was plated with silicon nanoparticles. A spoon was also plated, further demonstrating the versatility of the method. Unlike metal plating, silicon nanoparticle plating is self-limited. The plating current decreases over time. After 30 minutes of plating, for example, the current is one-half its original value. If plating continues for an extended period of time, additional material deposits but it does not stick. Upon removal from the tank, the top layer of the coating comes off, sinking as a cloud. The self-limiting property of the plating process may be countered by adding to the particle solution some conducting ions. Such mixing produces composite plating layers, though, opposed to a pure silicon nanoparticle plating.

Plating has also been achieved by simply replacing the 1 nm particles with other silicon nanoparticles of larger size. We demonstrated the process with red particles of 2.9 nm diameter. An alcohol solution of 2.9 nm particles was used. For those larger particles, the rate of deposition increases by an order of magnitude compared to plating with the 1 nm particles. The higher plating rate may be due to the larger surface area of the red particles.

The invention also includes embodiments for the deposit of silicon nanoparticle composite films. As mentioned above, the addition of ions to the silicon nanopariticle alcohol colloid produces composite thin film plating. Examples include aluminum or other conducting metals or their oxides as a composite with the luminescent Si nanoparticles. For a composite aluminum and silicon nanoparticle plating, for example, a tank of an alcohol solution in which the particles and aluminum chloride salt are dissolved operates at a current flow between the electrodes. As in metal plating, Al—Si particle plating occurs at the cathode. Thin film composites on metal, silicon substrates, foils, or conducting polymer films have been demonstrated. For biasing in the range of 10 to 50 Volts, the tank usually supports a current flow of ~1 to 10 milli ampere respectively.

Auger material analysis confirms that the film is a uniform composite of silicon nanoparticles and aluminum oxide, and optical spectroscopy shows that the film is highly luminescent. The process proceeds in terms of the formation of complex Al ions with the silicon particles tagging along as ligands. The procedure can be extended to other metals. The thickness of the film is controlled by controlling the period of the deposition, concentration of the material, and the current and voltage used. This would allow us to deposit ultrathin films. The percentage composition is controlled by varying the percentage concentration of the material in the solution. The oxidation of aluminum is a result of the presence of traces of water in the solution. Other metals, such as nickel, do not oxidize when plated. Aluminum oxide is a very useful matrix for the particles. It is a high hardness, high temperature material. A form of $Al_2O_3$ (corundum) is nearly as hard as diamond. Impurities in aluminum oxide have been known to give gems with beautiful colors. Ruby color is caused by $Cr^{3+}$ ions. To avoid oxidation of Al, we use anhydrous aluminum cholaride dissolved in ether with $LiAlH_4$ and the plating process is accomplished in an inert atmosphere, such as a nitrogen or an argon atmosphere.

Alternate built-up platings may also be formed by depositing stacks of alternating thin films of aluminum or other conducting metal compounds and luminescent Si nanoparticle. In this case, a tank of an alcohol solution in which only particles are dissolved operates at a current flow between the electrodes. After formation of the required film of particles, the film is immersed into a tank in which only aluminum chloride salt is dissolved. The reversed polarity is used to drive aluminum onto the particles. Once the required thickness is achieved, the film is then immersed into the particle plating tank, and so on. The previously discussed techniques for patterned plating deposits are also applicable here. Thus, composite and stacked platings offer potential for use flexible particle-based displays. These results have implications to flexible particle-based displays.

While a specific embodiment of the present invention has been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A method for plating silicon nanoparticles onto a substrate, the method comprising steps of:

providing an electrolytic cell including a solution including silicon nanoparticles and at least a portion of said substrate, and applying power to the electrolytic cell with the substrate as an electrode of the electrolytic cell to permit plating of silicon nanoparticles onto the substrate.

2. The method according to claim 1, wherein the substrate is metal.

3. The method according to claim 2, wherein the substrate is stainless steel.

4. The method according to claim 1, wherein the substrate is a silicon wafer.

5. The method according to claim 1, further comprising a preliminary step of patterning the substrate with material to define areas of different conductivity on the substrate.

6. The method according to claim 5, wherein the substrate comprises a silicon wafer and the material to define areas comprises a thermal oxide.

7. The method according to claim 1, wherein the substrate is gradually advanced into the electrolytic cell during said step of applying power.

8. The method according to claim 1, further comprising a steps of:

conducting an additional material plating after said step of applying power, the additional material plating comprising an electrolytic plating of the additional material.

9. The method according to claim 8, wherein the additional material is aluminum.

10. A method for plating a silicon nanoparticle composite onto a substrate, the method comprising steps of:

providing an electrolytic cell including a solution of silicon nanoparticles, metal ions and at least a portion of the substrate, applying power to the electrolytic cell with the substrate as an electrode of the electrolytic cell for a time to permit plating of silicon nanoparticles onto the substrate.

11. The method according to claim 10, wherein the substrate is metal.

12. The method according to claim 11, wherein the substrate is stainless steel.

13. The method according to claim 10, wherein the substrate is a silicon wafer.

14. The method according to claim 10, further comprising a preliminary step of patterning the substrate with material to define areas of different conductivity on the substrate.

15. The method according to claim 14, wherein the substrate comprises a silicon wafer and the material to define areas comprises a thermal oxide.

16. The method according to claim 10, wherein the substrate is gradually advanced into the electrolytic cell during said step of applying power.

17. The method according to claim 10, further comprising a steps of:

conducting an additional material plating after said step of applying power, the second plating comprising an electrolytic plating of the additional material.

* * * * *

UNITED STATES PATENT AND TRADEMARK OFFICE

CERTIFICATE OF CORRECTION

PATENT NO. : 6,660,152 B2
DATED : December 9, 2003
INVENTOR(S) : Nayfeh et al.

It is certified that error appears in the above-identified patent and that said Letters Patent is hereby corrected as shown below:

Column 1,
Line 30, insert -- termination, -- between "O-" and "or"

Signed and Sealed this

Seventh Day of December, 2004

JON W. DUDAS
*Director of the United States Patent and Trademark Office*